US007431526B2

(12) United States Patent
Lin

(10) Patent No.: US 7,431,526 B2
(45) Date of Patent: Oct. 7, 2008

(54) PEN WITH PAPER ROLL

(75) Inventor: Chao-Jen Lin, Taipei (TW)

(73) Assignee: Taiwan Mindcatcher, Inc., Taipei County (TW)

( * ) Notice: Subject to any disclaimer, the term of this patent is extended or adjusted under 35 U.S.C. 154(b) by 320 days.

(21) Appl. No.: 11/097,237

(22) Filed: Apr. 4, 2005

(65) Prior Publication Data

US 2006/0222442 A1 Oct. 5, 2006

(51) Int. Cl.
*B43K 29/00* (2006.01)
*B65D 85/02* (2006.01)
*B65H 16/00* (2006.01)

(52) U.S. Cl. ..... 401/195; 242/588.6; 242/550

(58) Field of Classification Search ..... 401/195; 242/55, 55.53, 55.5, 588.6, 350, 902, 554.5, 242/555, 550, 555.3
See application file for complete search history.

(56) References Cited

U.S. PATENT DOCUMENTS 1,561,725 A * 11/1925 Kerley ..... 40/334
2,099,268 A * 11/1937 West et al. ..... 242/379
2,111,362 A * 3/1938 Fisher ..... 40/335
2,508,372 A * 5/1950 Carlson ..... 242/379.2
2,512,168 A * 6/1950 Moore ..... 206/389
2,991,952 A * 7/1961 Marchuck et al. ..... 242/405
4,502,226 A * 3/1985 Hung ..... 33/760
4,812,775 A * 3/1989 Klinkowstein et al. ..... 315/506
6,283,661 B1 * 9/2001 Connors ..... 401/195
7,073,745 B2 * 7/2006 Flis ..... 242/588.6

* cited by examiner

*Primary Examiner*—David J Walczak

(57) ABSTRACT

A pen with a paper roll is disclosed. A volute spring surrounded by the paper roll is fastened on a reel. A volute spring pushes the paper roll for keeping the outer surface of the paper roll to touch a barrel which contains the paper roll. The surface of barrel has the prominent lines for decreasing the friction between the outer surface of the paper roll and the inner surface of the barrel. The barrel is configured in an outer casing of a pen, and the barrel and the outer casing have a first opening and a second opening separately. The first opening and the second opening is correspondent to each other. One side of the second opening is an inward bevel edge which extends into the first opening and interferes with the outer tier of the paper roll. The outer end of the paper roll can be pushed out of the first opening and the second opening against the inward bevel edge.

8 Claims, 6 Drawing Sheets

PEN WITH PAPER ROLL

BACKGROUND OF THE INVENTION

1. Field of the Invention

The present invention generally relates to a writing tool, and more particularly to a pen with a paper roll.

2. Description of the Prior Art

Binding slices, such as paper roll, roll films, or aluminum foils, are often used daily. For reeling in/out the flexible binding slices properly, a plurality of containers for containing the flexible binding slices are provided.

It is very import to prevent the roll of the binding slice loose, blocked, or entangled when the binding slice is reeling in/out, whereby the binding slice can be effectively reeled out for use or reeled in for storage.

In general, there are three design models for using a flexible paper roll configured in a container for reeling the binding slice. One of the design models applies inner thrust generated by rotating the reel to reel out the roll. The other of the design models applies the pulling force to pull the outer end of the roll. Another of the design models applies both of the thrust and the pulling force. No matter which one is applied, the design to prevent reverse by using the thrust or the design to keep the outer end of the roll out of the opening all focus on the limitation of the inner end or the outer end of the roll. However the problem that the roll would become loose in the prior art still has no effective solution. Some methods add viscose on one surface of the roll to resolve the loose problem, but such a roll can be only reel out and impossible to reel in.

Thus, a design for reeling in/out a roll of a binding slice which is well-proportionally configured in the reeling container is needed. Such a design can resolve the forgoing defects, whereby the reeling container can be light and handy, applied, and reeled out for use or reeled in for storage. According to such a design, the roll can be reeled out/in smoothly by reeling.

SUMMARY OF THE INVENTION

Therefore, in accordance with the previous summary, objects, features and advantages of the present disclosure will become apparent to one skilled in the art from the subsequent description and the appended claims taken in conjunction with the accompanying drawings.

One objective of the present invention is to apply a volute spring for shoving the roll of a binding slice out, whereby the binding slice can be easy to be reeled out via an opening of the barrel.

Another objective of the present invention is to provide each opening of the barrel and an outer casing an inward bevel edge.

One further objective of the present invention is to apply a volute spring to reel out/in the binding slice, wherein the volute spring can gradually increase the inner space in the barrel for storing the reeled in binding slice.

Accordingly, a pen with a paper roll is disclosed. A volute spring surrounded by the paper roll is fastened on a reel. A volute spring pushes the paper roll for keeping the outer surface of the paper roll to touch a barrel which contains the paper roll. The surface of barrel has the prominent lines for decreasing the friction between the outer surface of the paper roll and the inner surface of the barrel. The barrel is configured in an outer casing of a pen, and the barrel and the outer casing have a first opening and a second opening separately. The first opening and the second opening is correspondent to each other. One side of the second opening is an inward bevel edge which extends into the first opening and interferes with the outer tier of the paper roll. The outer end of the paper roll can be pushed out of the first opening and the second opening against the inward bevel edge.

BRIEF DESCRIPTION OF THE DRAWINGS

The accompanying drawings incorporated in and forming a part of the specification illustrate several aspects of the present invention, and together with the description serve to explain the principles of the disclosure. In the drawings.

DETAILED DESCRIPTION OF THE PREFERRED EMBODIMENTS

Figure 1A:
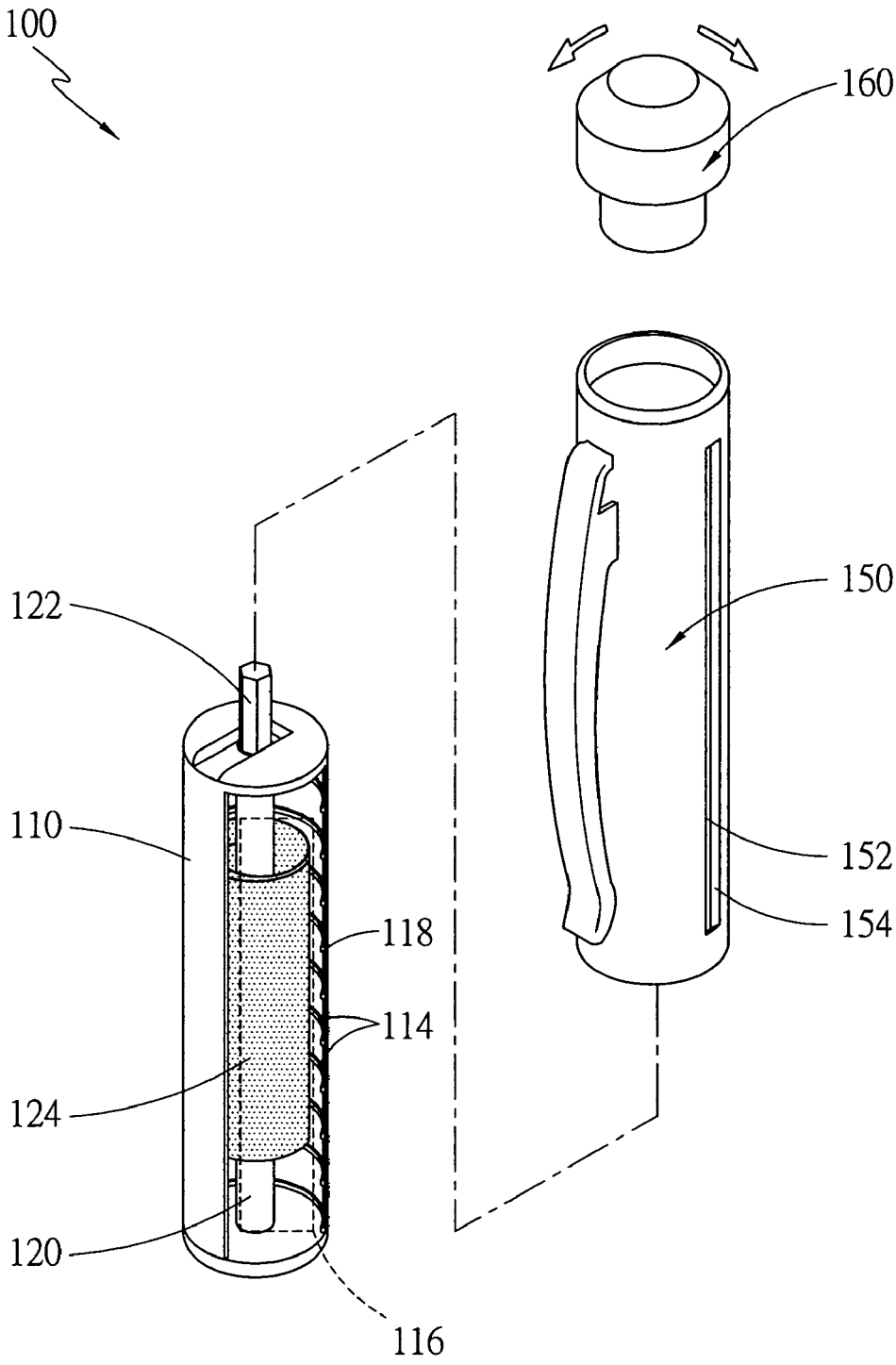
FIG. 1A and FIG. 1B illustrate a structure diagram according one embodiment of the present invention.

The present disclosure can be described by the embodiments given below. It is understood, however, that the embodiments below are not necessarily limitations to the present disclosure, but are used to a typical implementation of the invention.

Having summarized various aspects of the present invention, reference will now be made in detail to the description of the invention as illustrated in the drawings. While the invention will be described in connection with these drawings, there is no intent to limit it to the embodiment or embodiments disclosed therein. On the contrary the intent is to cover all alternatives, modifications and equivalents included withe spirit and scope of the invention as defined by the appended claims.

It is noted that the drawings presents herein have been provided to illustrate certain features and aspects of embodiments of the invention. It will be appreciated from the description provided herein that a variety of alternative embodiments and implementations may be realized, consistent with the scope and spirit of the present invention.

It is also noted that the drawings presents herein are not consistent with the same scale. Some scales of some components are not proportional to the scales of other components in order to provide comprehensive descriptions and emphasizes to this present invention.

Figure 1B:
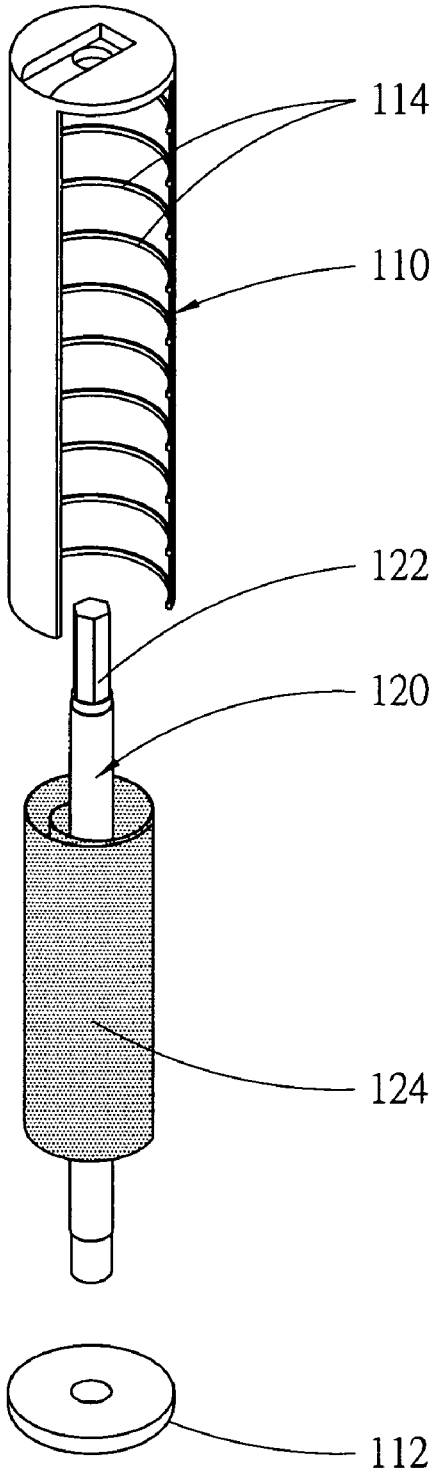

Referring to FIG. 1A and FIG. 1B, which illustrate a structure diagram of a writing tool with a paper roll according to one embodiment of the present invention. The writing tool 100 includes a barrel 110, a reel 120, and a volute spring 124, wherein the barrel has a first opening 116. The reel 120 is limited to rotate in the axle within the barrel 110, wherein one end 122 of the reel 120 extends out of the barrel 110. The volute spring 124 is a volute metallic reed, whose inner end is fastened on the reel 110. Thus the volute spring 124 follows the reel 120 to rotate, whereby a roll fastened on the volute spring 124 can be driven to rotate, too. Besides, the inner surface of the barrel 110 includes one or a plurality of prominent lines or ridges 114 for decreasing the friction between inner surface of the barrel 110 and the outer surface of the roll. The forgoing barrel 110 is configured within a pen. The pen includes a outer casing 150 where the barrel 110 is fastened inside. Furthermore, the outer casing 150 includes a screw cap 160 connected with the end 122 of the reel 120 out of the barrel 110. Thus, the reel 120 can be reeled clockwise or counter-clockwise by reeling the screw cap 160. In addition, the outer casing includes a second opening 152, which has a inward bevel edge 154 on one side. The inward bevel edge 154 inclines toward another inward bevel edge 118 of the first opening 116. The embodiment can further include a bottom plate 112, wherein said bottom plate 112 is connected to form the bottom of said barrel, and said bottom plate has a hole for locating the bottom end of said reel.

Figure 1C:
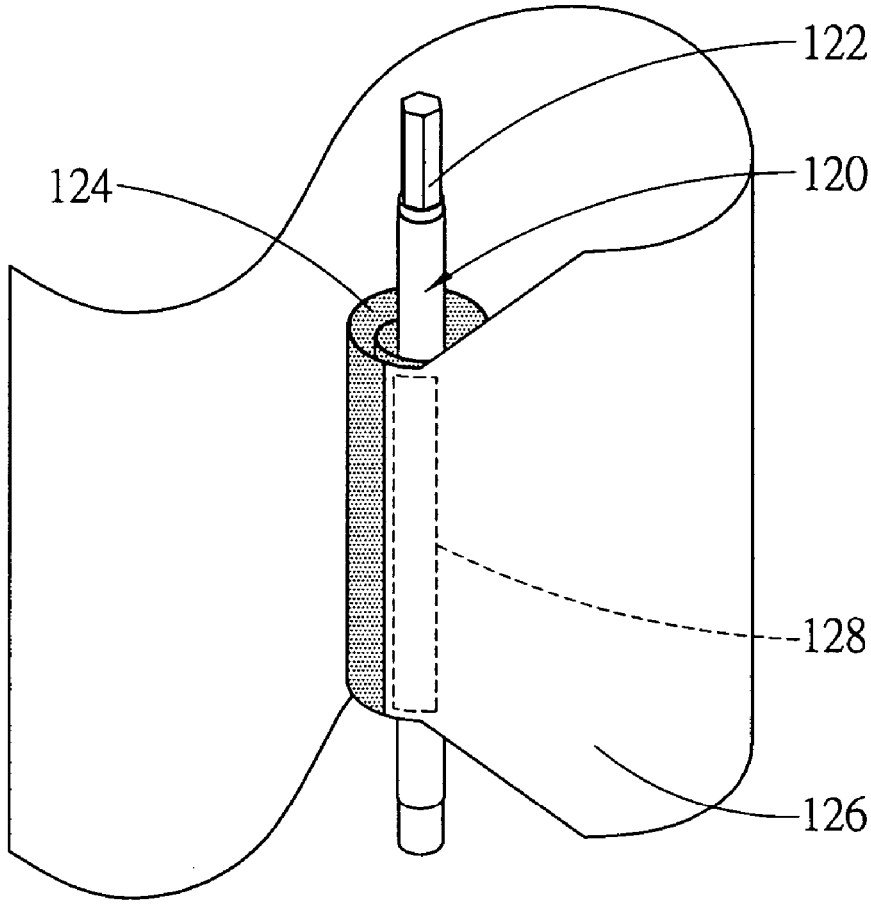
FIG. 1C is a assembly diagram of the volute spring and the binding slice.
Figure 1D:
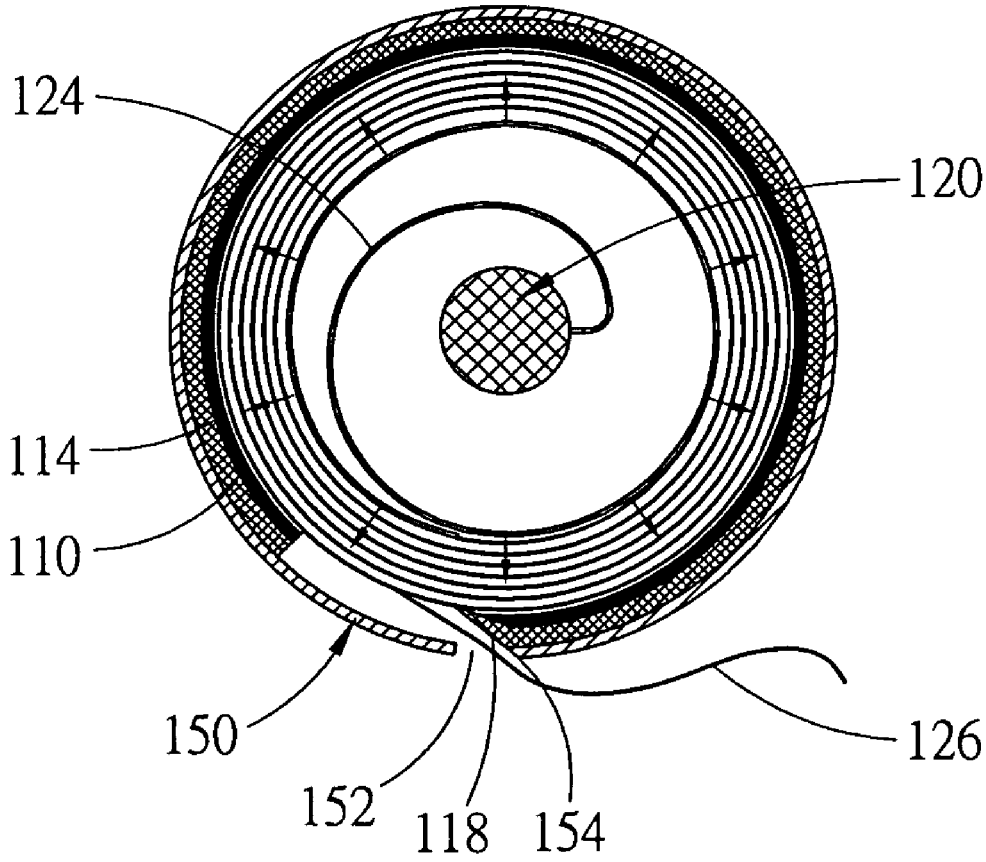
FIGS. 1D and 1E are section diagrams according to one embodiment of the present invention.
Figure 1E:
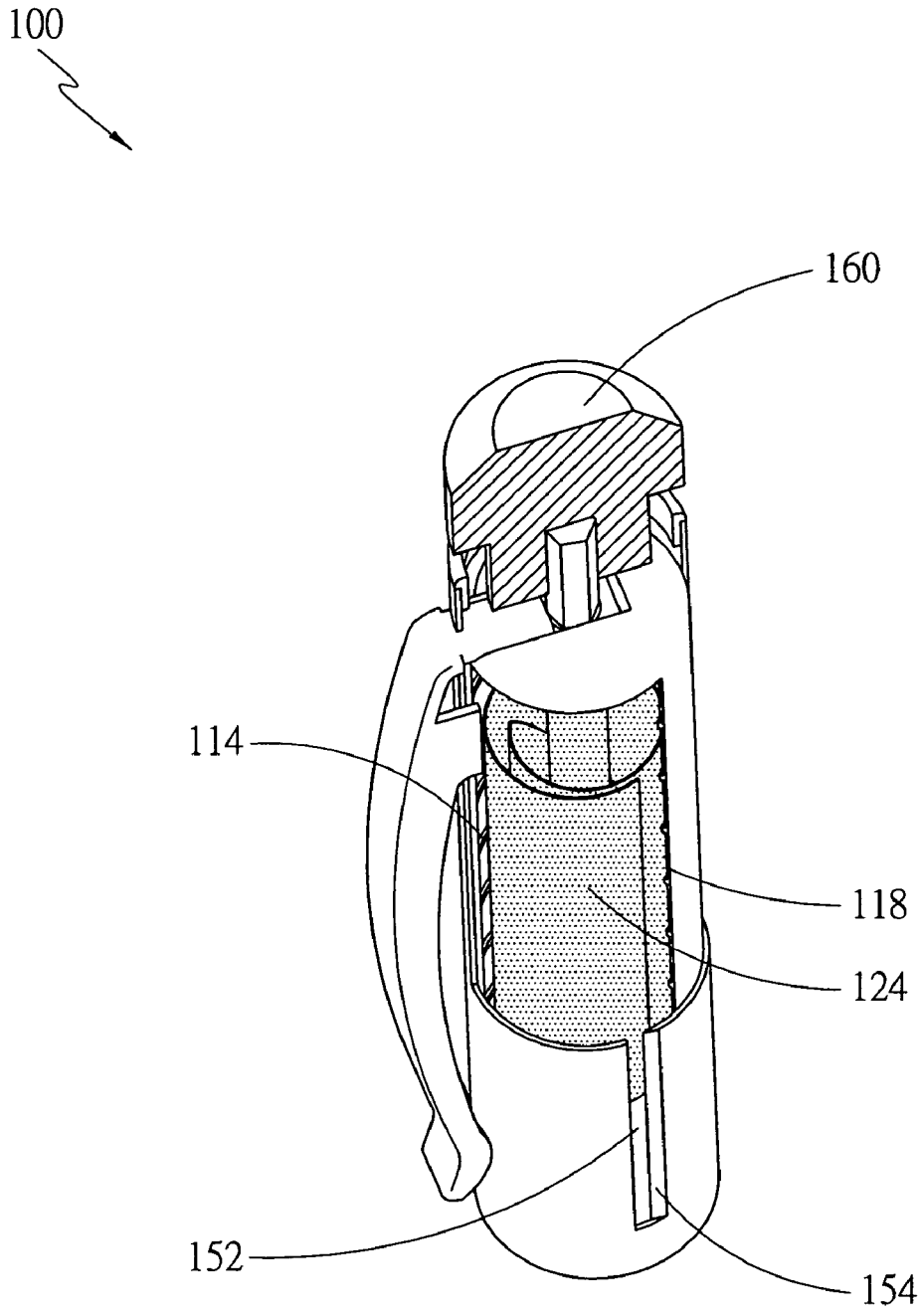
Figure 1F:
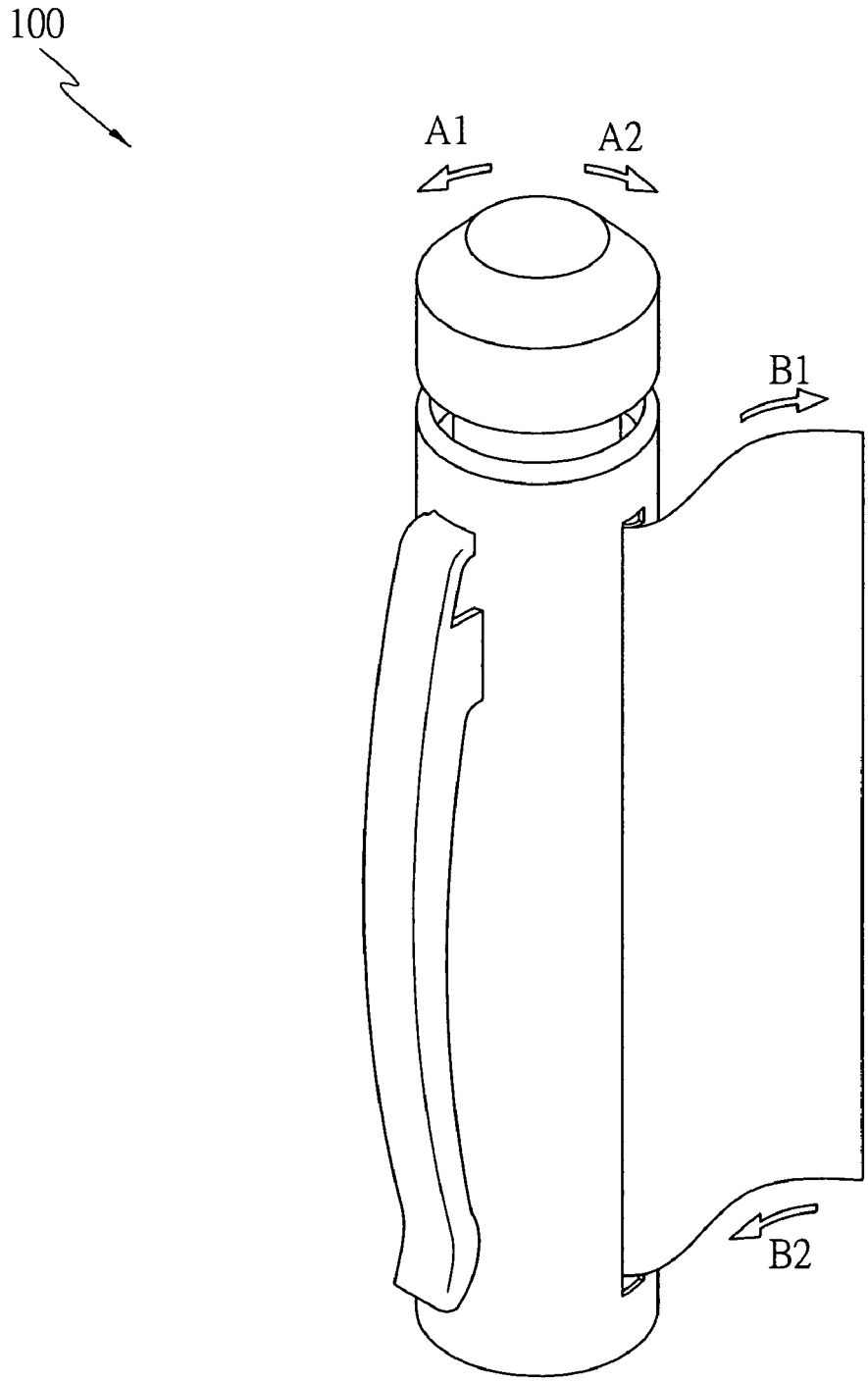
FIG. 1F is a diagram of a finished goods according to one embodiment of the present invention.

Moreover, the embodiment of the present invention further includes a binding slice 126 referring to FIG. 1C and FIG. 1D. The inner end 128 of the binding slice 126 is fastened and wound on the volute spring 124 for following the reel 120 to rotate. That is, the barrel 110, the binding slice 126, the volute spring 124, and the reel 120 form a binding slice containing barrel. Referring to FIG. 1E, the outer surface of the roll of the binding slice 126 is pushed to contact the inner surface of the barrel 110 by the volute spring 124 to form a tide roll layer upon layer. Therefore, the outer end of the binding slice 126 can be reeled out of the first opening 116 by rotating the reel 120 counter-clockwise (or clockwise) or reeled in the first opening 116 by rotating the reel 120 clockwise (counter-clockwise). Due to the first inward bevel edge 118 inclines into the first opening 116, the first inward bevel edge 118 pushes against the outer surface of the roll of the binding slice 126. After the outer end of the binding slice 126 is reeled to reach the first opening 116, the outer end of the binding slice 126 will contact the first inward bevel edge 118 and then be reeled out to reach the second opening 152 against the first inward bevel edge 118. FIG. 1F illustrates a diagram of a finished goods, a writing tool with a paper roll, according one embodiment of the present invention. The binding slice can be paper, self-adhesive paper, plastic slice, or other flexible material. When a user rotates the screw cap on the top of the writing tool 100 clockwise (A1 in FIG. 1F) or counter-clockwise (A2 in FIG. 1F), the forgoing binding slice will be reeled out or in toward the direction B1 or B2 separately.

The foregoing description is not intended to be exhaustive or to limit the invention to the precise forms disclosed. Obvious modifications or variations are possible in light of the above teachings. In this regard, the embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are with the scope of the inventions as determined by the appended claims when interpreted in accordance with the breath to which they are fairly and legally entitled.

It is understood that several modifications, changes, and substitutions are intended in the foregoing disclosure and in some instances some features of the invention will be employed without a corresponding use of other features. Accordingly, it is appropriate that the appended claims be construed broadly and in a manner consistent with the scope of the invention.

The invention claimed is:

1. A barrel for containing a binding slice, comprising:

a barrel with a first opening;

a singular, unitary reel limited to rotate in the barrel, wherein one end of said reel extends out of the barrel;

a volute spring, wherein said volute spring is a volute metallic reed with an inner end fastened on said reel for following the reel to rotate;

a binding slice, wherein the inner end of said binding slice is fastened and wound on said volute spring for following the reel to rotate, and the outer surface of said binding slice is pushed by said volute spring to contact the inner surface of said barrel, such that minimal slack of the binding slice is maintained while contacting the inner surface of said barrel, wherein the outer end of said binding slice is reeled in and out by rotating said reel, and wherein the inner surface of said barrel comprises at least one prominent ridge for decreasing the friction between said inner surface of said barrel and said outer surface of said binding slice; and a bottom plate, wherein said bottom plate is connected to form the bottom of said barrel, and said bottom plate has a hole for locating the bottom end of said reel.

2. A barrel for containing a binding slice of claim 1, the barrel has a first opening and said outer end of said binding slice is reeled out of said first opening by rotating said reel.

3. A barrel for containing a binding slice of claim 2, wherein one side of said first opening is a first inward bevel edge, and said first inward bevel edge is against said outer surface of said binding slice, wherein said outer end of said binding slice is guided by said first inward bevel edge to be reeled out of said first opening.

4. A barrel for containing a binding slice of claim 1, wherein said binding slice is a flexible material.

5. A barrel for containing a binding slice of claim 4, wherein said flexible material is selected from the following group: a paper, a self-adhesive paper, and a plastic slice.

6. A writing tool with a binding slice, comprising:

a barrel with a first opening, wherein said first opening comprises a first inward bevel edge;

a singular, unitary reel limited to rotate in the barrel, wherein one end of said reel extends out of the barrel;

a volute spring, wherein said volute spring is a volute metallic reed, whose inner end is fastened on said reel for following the reel to rotate;

a binding slice, wherein the inner end of said binding slice is fastened and wound on said volute spring for following the reel to rotate, and the outer surface is pushed by said volute spring to contact the inner surface of said barrel, such that minimal slack of the binding slice is maintained while contacting the inner surface of said barrel, wherein the outer end of said binding slice can be reeled in and out by rotating said reel, and wherein the inner surface of said barrel comprises at least one prominent ridge for decreasing the friction between said inner surface of said barrel and said outer surface of said binding slice;

a bottom plate, wherein said bottom plate is connected to form the bottom of said barrel, and said bottom plate has a hole for locating the bottom end of said reel; and a pen with a outer casing, wherein said outer casing has a second opening and said barrel is configured inside said outer casing, wherein said second opening is corresponding to said first opening and the outer end of said binding slice is reeled out of said second opening by the guiding of said first inward bevel edge of said first opening.

7. A writing tool with a binding slice of claim 6, wherein one side of said second opening comprises a second inward bevel edge and said binding slice is reeled out of said second opening by the guiding of said first inward bevel edge and said second inward bevel edge.

8. A writing tool with a binding slice of claim 6, wherein said binding slice is a flexible material.

* * * * *